United States Patent [19]

Schweingrüber et al.

[11] Patent Number: 4,578,861

[45] Date of Patent: Apr. 1, 1986

[54] SHAVING HEAD FOR DRY SHAVERS

[75] Inventors: Otto Schweingrüber, Glashütten; Peter Hilfinger, Bad Homburg; Dietrich Pahl, Hofheim-Langenhain, all of Fed. Rep. of Germany

[73] Assignee: Braun Aktiengesellschaft, Kronberg, Fed. Rep. of Germany

[21] Appl. No.: 567,082

[22] Filed: Dec. 30, 1983

[30] Foreign Application Priority Data

Jan. 27, 1983 [DE] Fed. Rep. of Germany ..... 3302610

[51] Int. Cl.[4] ..... B26B 19/02

[52] U.S. Cl. ..... 30/43.92; 30/346.51

[58] Field of Search ..... 30/43.92, 43.9, 43.6, 30/346.51

[56] References Cited

U.S. PATENT DOCUMENTS

| | | | |
|---|---|---|---|
| 3,824,687 | 7/1974 | Baumann | 30/43.92 |
| 4,271,590 | 6/1981 | Ernst et al. | 30/43.92 |

FOREIGN PATENT DOCUMENTS

| | | |
|---|---|---|
| 219452 | 6/1961 | Austria . |
| 2203926 | 1/1972 | Fed. Rep. of Germany . |
| 2405462 | 2/1973 | Fed. Rep. of Germany . |
| 2857468 | 10/1978 | Fed. Rep. of Germany . |

*Primary Examiner*—Douglas D. Watts

*Attorney, Agent, or Firm*—Raymond J. De Vellis

[57] ABSTRACT

In a shaving head for dry shavers with a shaving head frame removably disposed on the shaver housing an an interchangeable frame insertable therein, in which a shaving foil cooperating with a reciprocating cutting head is convexly tensioned, the interchangeable frame is positively locked directly to the shaver housing.

12 Claims, 5 Drawing Figures

FIG.1
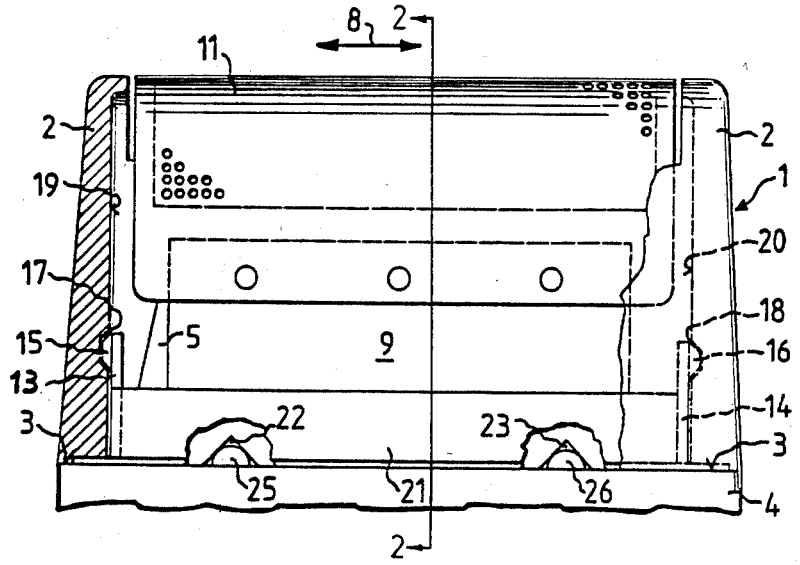
FIG.2
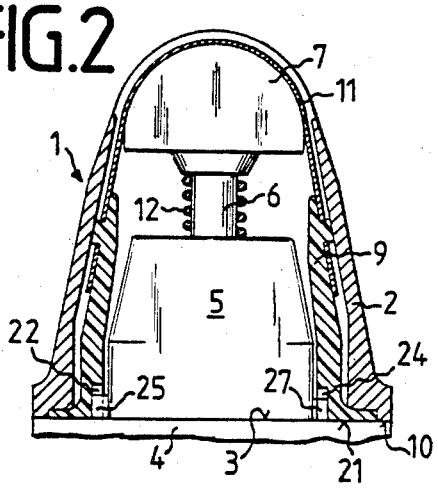
FIG.4
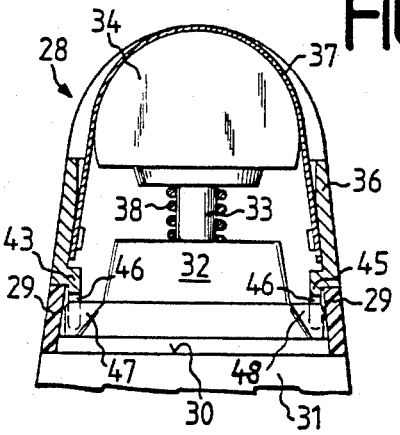
FIG.3.A
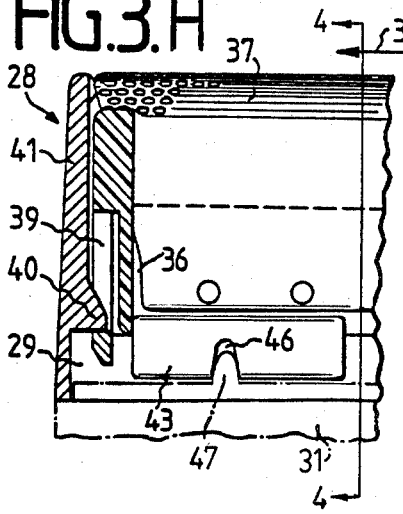
FIG.3.B
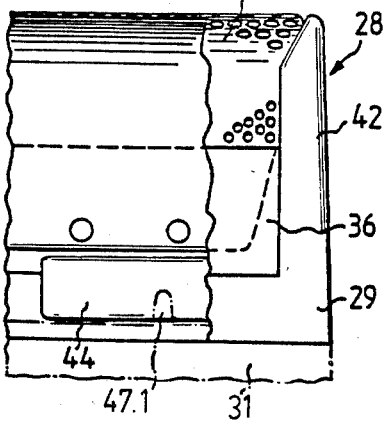

SHAVING HEAD FOR DRY SHAVERS

BACKGROUND OF THE INVENTION

The invention relates to a shaving head for a dry shaver. More particularly, the invention relates to a shaving head frame removably mounted on a shaver housing. The shaving head frame includes an interchangeable frame insertable therein. A shaving foil which cooperates with a reciprocating cutting head is convexly tensioned in the interchangeable frame.

SUMMARY OF THE INVENTION

Shaving heads such as that shown in U.S. Pat. No. 4,271,590 assigned to assignee of the present invention have the advantage that they are readily disassembled and reassembled for cleaning, for replacing damaged or worn shaving foils, and for repairs in general. In particular, removal and installation of the shaving foil is easily accomplished even by lay persons and inexperienced users since the interchangeable frame holds the shaving foil without having the foil exposed to the danger of damage during these procedures. Mass producing such a shaving head design, however, requires accuracy in manufacturing the components involved since relatively close dimensional tolerances are required to ensure the desired precise cooperation of the shaving action of the cutting head with the cutting edges of the shaving foil over the entire contact area. Unfavorable cumulative tolerances of the various components can produce an end product which, because of excessive looseness, is noisy or, because of defective centering of the shaving foil with respect to the cutting head, has a tendency to exhibit poor cutting behavior and uneven wearing of the cutting parts. Correction of this problem is most difficult in a mass production environment.

The goal of the invention, in a shaving head of the type recited hereinabove, with retention of the advantages of an interchangeable frame, is to improve the centering of the shaving foil relative to the cutting head, and to ensure a largely vibration-free mounting of the interchangeable frame.

The invention achieves this goal in a surprisingly simple fashion by a direct positive latching of the interchangeable frame with the shaver housing. The latching acts in or parallel to the operating movement of the cutting head. The coupling of the interchangeable frame with the housing, according to the invention, advantageously interrupts the tolerance chain from the cutting head to the shaving foil with practically negligible manufacturing expense. The connection between the housing and the shaving head frame, which is by nature subject to considerable looseness, is removed from the tolerance chain so that the unsatisfactory tolerances that appear at this point cannot have an undesirable effect on the shaving action. The locking of the interchangeable frame with the housing according to the invention can be used alone in theory. However, it is advantageous to retain the previously conventional connection of the interchangeable frame with the shaving head frame, as a loose connection, without any special quality requirements, in order to prevent the interchangeable frame from falling out of the shaving head frame when the latter is removed from the housing. This removal is especially facilitated if, in an embodiment of the invention, the locking or latching connection of the interchangeable frame with the housing is releasable in a direction transverse to the operating movement of the cutting head. This direction is essentially the direction in which the shaving head is removed from the housing.

In a similar embodiment of the invention, the interchangeable frame is provided with cutouts which cooperate with projections integral with the housing. Alternatively, the interchangeable frame can be provided with projections which are then insertable into cutouts in the shaver housing.

In an embodiment of the dry shaver, in which the housing fits flush with the shaving head frame, it is advantageous to provide the locking means on a molding on the housing, upon which the shaving head frame and the interchangeable frame rest, at least partially.

In another embodiment, in which both the shaving head frame and the interchangeable frame are externally flush with the housing, it is advantageous to provide the locking or latching means on the frame by providing a strip of the interchangeable frame which is staggered inward.

Finally, it is advantageous for a secure positioning of the interchangeable frame on the housing to provide at least one locking point on opposite sides of the interchangeable frame.

BRIEF DESCRIPTION OF THE DRAWINGS

Referring now to the drawings in which;

FIG. 1 is a side view of a first embodiment of the shaving head, partially cut away;

FIG. 2 is a cross sectional view taken on lines 2—2 through the shaving head frame mounted on the housing, and the interchangeable frame of the shaving head according to FIG. 1;

FIGS. 3A and 3B are side views of the shaving head of a second embodiment, partially cut or broken away, showing a detail in two versions; and FIG. 4 is a cross sectional view taken on lines 4—4 through the shaving head frame mounted on the housing and the interchangeable frame of the shaving head shown in FIG. 3.

DETAILED DESCRIPTION OF THE PREFERRED EMBODIMENT

Figure 5:
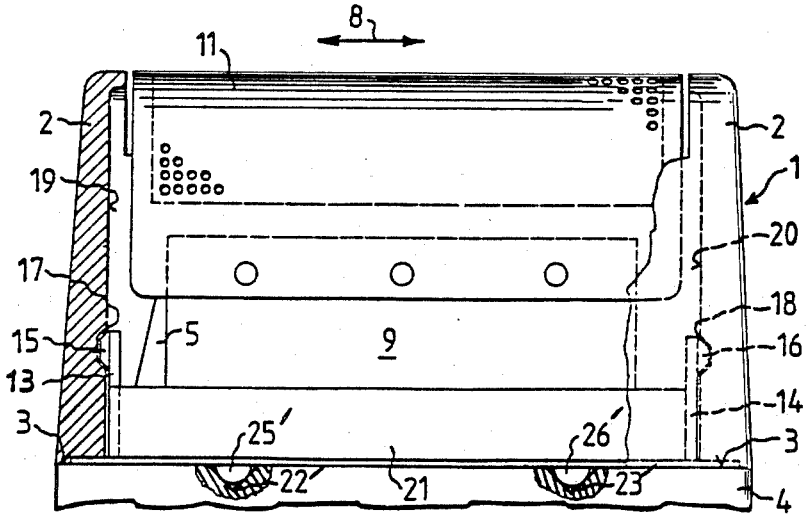

The shaving head 1 of a dry shaver, shown in FIG. 1, consists essentially of a shaving head frame 2, which is mountable on a molding 3 of a shaver housing 4, and surrounds a dome-shaped upper part 5 of housing 4. An oscillating lever 6 is located on a motor (not shown). The lever 5 in housing 4 projects out of the upper part of housing 5. The motor causes the cutting head 7 to reciprocate in the direction of double arrow 8, hereinbelow referred to as the working movement. An interchangeable frame 9 is insertable into shaving head frame 2. The frame 9 is flush against molding 3 with lower edge 10 of shaving head frame 2, and in which frame 9 a shaving foil 11 is convexly tensioned, said foil cooperating with cutting head 7 in a manner well known in the art. A coil spring 12 presses cutting head 7 against shaving foil 11. Spring-loaded tongues 13 and 14 are provided on the two ends of interchangeable frame 9, said tongues engaging with their heads 15 and 16, matching recesses 17 and 18 on the inner surfaces of end cheeks 19 and 20 of shaving head frame 2, thus substantially preventing interchangeable frame 9 from falling out when shaving head frame 2 is removed.

At the lower edge 21 of interchangeable frame 9, wedge-shaped cutouts 22, 23, and 24 are provided on both sides, into which cutouts projections 25, 26, and 27, equipped with round heads and formed on molding 3 of housing 4, engage, thus preventing frame 9 from making its own movements in the direction of arrow 8. The connection is releasable transversely to the direction of arrow 8.

Shaving head 28 shown in FIGS. 3A and 3B and 4 has a construction principle similar to that described above. It consists of a shaving head frame 29, mountable on a molding 30 of shaver housing 31, and surrounding a dome-shaped upper part 32 of housing 31. Oscillating lever 33 of the motor, likewise not shown, projects out of this upper part, said lever causing a cutter head 34 to reciprocate in the direction of double arrow 35, in a reciprocating movement, the working movement. An interchangeable frame 36 is insertable into shaving head frame 29 in such fashion that both frames 29 and 36 fit flush along the outer surfaces both with each other and with housing 31. A shaving foil 37 is convexly tensioned in interchangeable frame 35, said foil cooperating with cutting head 34; both shaving parts are pressed against each other by a coil spring 38 acting on cutting head 34.

For protection against falling out of shaving head frame 29, interchangeable frame 36 is provided on its ends with spring-loaded tongues 39, with only one tongue 39 shown in FIG. 3A, said tongues fitting beneath a hook-shaped projection 49 on the inner surface of end cheeks 41 and 42 of shaving head frame 29.

Downwardly projecting strips 43, 44, 45 are formed on the inside of interchangeable frame 36, said strips being provided as shown in FIG. 3A with a wedge-shaped cutout 46, into which projections 47, 48 provided on housing 31 engage; according to FIG. 3B, a cutout can also be provided on projection 47.1, into which the corresponding strip 44 engages positively. In FIGS. 3A and 3B, housing 31 with its associated projections 47 and 47.1 is indicated by dot-dashed lines for improved clarity. The positive latches produced by cutouts 43, 44, 45, and projections 47, 47.1, and 48 can be provided both in the embodiment shown in FIG. 3A and in the embodiment shown in FIG. 3B, and can also be combined; advantageously, the locking devices are provided on the sides of the frame that are opposite each other, as shown in FIG. 4.

The latches which can easily be opened by lifting shaving head frame 29 upward, protect the interchangeable frame against making movements of its own in the direction of the working movement shown by double arrow 25 of the cutting head, caused by entrainment via cutting foil 47 under the pressure of shaving, and contributing to centering the cutting head reliably against the shaving foil.

In the two embodiments described hereinabove of the shaving head, mounting the interchangeable frame directly on the shaver housing permits compensating for any variations in size that may occur in the shaver housing relative to the shaving head frame by virtue of the spring-loaded tongues, which serve to hold the two frames together.

While embodiments and applications of the invention have been shown and described, it will be apparent to those skilled in the art that many more modifications are possible without departing from the inventive concepts herein described.

What is claimed as new and desired to be secured by Letters Patent of the United States is:

1. A dry shaver comprising:

a shaver housing;

a removable shaving head frame releasably mounted on said shaver housing and fitting flush therewith:

an elongated interchangeable frame member having ends spaced from one another in the direction of elongation, said interchangeable frame member having a first longitudinal side connecting said ends, said ends including means for releasably mounting said interchangeable frame member in said shaving head frame;

a shaving foil convexly tensioned and attached to said interchangeable frame;

a reciprocating cutting head cooperating with said shaving foil; and latching means on said first longitudinal side of said interchangeable frame member and on said shaver housing for providing a direct positive latching action in or parallel to the reciprocating direction of said cutting head, said interchangeable frame member being releasable from said shaver housing in a direction transverse to said reciprocating direction of said cutting head, said latching means including first projection means, including at least one rounded projection, and formed on an upper surface of said shaver housing, and also including first cut out means formed on a lower edge of said first longitudinal side of said interchangeable frame member, said first cut out means including at least one wedge-shaped cut out and being engageable over said first projection means to prevent said interchangeable frame member from moving in the reciprocating direction of said cutting head whereby relative motion between said interchangeable frame member and said shaver housing is substantially prevented.

2. The dry shaver as in claim 1, wherein said shaving head frame fits flush with said shaver housing, said latching means including first projection means formed on an upper surface of said shaver housing, and also including first cut out means formed on a lower edge of said first longitudinal side of said interchangeable frame member, said first cut out means being engageable over said first projection means to prevent said interchangeable frame member from moving in the reciprocating direction of said cutting head.

3. The dry shaver as in claim 8, wherein said elongated interchangeable frame member includes a second longitudinal side connecting said ends, and wherein said latching means further includes a second rounded projection means formed on said upper surface of said shaver housing, and also includes a second wedge-shaped cut out means formed on a lower edge of said second longitudinal side of said interchangeable frame member, said second cut out means being engageable over a said second projection means, to prevent said interchangeable frame member from moving in the reciprocating direction of said cutting head.

4. A dry shaver comprising:

a shaving housing;

a removable shaving head frame releasably mounted on said shaver housing and fitting flush therewith;

an elongated interchangeable frame member having ends spaced from one another in the direction of elongation, said interchangeable frame member having a first longitudinal side connecting said ends, said ends including means for releasably mounting said interchangeable frame member in said shaving head frame;

a shaving foil convexly tensioned and attached to said interchangeable frame;

a reciprocating cutting head cooperating with said shaving foil; and latching means on said first longitudinal side of said interchangeable frame member and on said shaver housing for providing a direct positive latching action in or parallel to the reciprocated direction of said cutting head, said interchangeable frame member being releasable from said shaver housing in a direction transverse to said reciprocating direction of said cutting head, said latching means including first cut out means having at least one wedge-shaped cut out and formed on an upper surface of said shaver housing, and also including first projection means having at least one rounded projection and formed on a lower edge of said first longitudinal side of said interchangeable frame member, said first cut out means being engageable over said first projection means to prevent said interchangeable frame member from moving in the reciprocating direction of said cutting head whereby relative motion between said interchangeable frame member and said shaver housing is substantially prevented.

5. The dry shaver as in claim 4, wherein said elongated interchangeable frame member includes a second longitudinal side connecting said ends, and wherein said latching means further includes a second wedge-shaped cut out means formed on said upper surface of said shaver housing, and also includes a second rounded projection means formed on a lower edge of said second longitudinal side of said interchangeable frame member, said second cut out means being engageable over said second projection means, to prevent said interchangeable frame member from moving in the reciprocating direction of said cutting head.

6. A dry shaver comprising:

a shaver housing;

a removable shaving head frame, externally flush with said shaver housing, releasably mounted on said shaver housing;

an elongated interchangeable frame member having ends spaced from one another in the direction of elongation, said interchangeable frame member having a first longitudinal side connecting said ends, said ends including means for releasably mounting said interchangeable frame member in said shaving head frame;

a shaving foil convexly tensioned and attached to said interchangeable frame;

a reciprocating cutting head cooperating with said shaving foil; and latching means on said first longitudinal side of said interchangeable frame member and on said shaver housing for providing a direct positive latching action in or parallel to the reciprocating direction of said cutting head, said interchangeable frame member being releasable from said shaver housing in a direction transverse to said reciprocating direction of said cutting head, said latching means including an inwardly staggered strip member formed on said first longitudinal side of said interchangeable frame member, said strip member having first cut out means, said latching means also including first projection means formed on an upper surface of said shaver housing, said first cut out means being engageable over said projection means to prevent said interchangeable frame from moving in the reciprocating direction of said cutting head.

7. The dry shaver as in claim 6, wherein said elongated interchangeable frame member includes a second longitudinal side connecting said ends, and wherein said latching means further includes a second inwardly staggered strip member having a second cut out means formed on said second longitudinal side of said interchangeable frame member, said latching means also including a second projection means formed on said upper surface of said shaver housing, said second cut out means being engageable over said second projection means to prevent said interchangeable frame member from moving in the reciprocating direction of said cutting head.

8. The dry shaver as in claim 7, wherein said first and second cut out means are wedge-shaped and said first and second projection means are rounded.

9. A dry shaver comprising:

a shaver housing;

a removable shaving head frame, externally flush with said shaver housing, releasably mounted on said shaver housing;

an elongated interchangeable frame member having ends spaced from one another in the direction of elongation, said interchangeable frame member having a first longitudinal side connecting said ends, said ends including means for releasably mounting said interchangeable frame member in said shaving head frame;

a shaving foil convexly tensioned and attached to said interchangeable frame;

a reciprocating cutting head cooperating with said shaving foil; and latching means on said first longitudinal side of said interchangeable frame member and on said shaver housing for providing a direct positive latching action in or parallel to the reciprocating direction of said cutting head, said interchangeable frame member being releasable from said shaver housing in a direction transverse to said reciprocating direction of said cutting head, said latching means including an inwardly staggered strip member formed on said first longitudinal side of said interchangeable frame member, said strip member having a first projection means including a cut out portion, said latching means also including a second projection means formed on an upper surface of said shaver housing, said cut out portion of said first projection means being engageable over said second projection means to prevent said interchangeable frame member from moving in the reciprocating direction of said cutting head.

10. The dry shaver as in claim 8, wherein said elongated interchangeable frame member includes a second longitudinal side connecting said ends and wherein said latching means further includes a second inwardly staggered strip member having a second projection means formed on said second longitudinal side of said interchangeable frame member, said latching means also including a second cut out means formed on said upper surface of said shaver housing, said second cut out means being engageable over said second projection means to prevent said interchangeable frame member from moving in the reciprocating direction of said cutting head.

11. The dry shaver as in claim 10, wherein said first and second cut out means are wedge-shaped and said first and second projection means are rounded.

12. The dry shaver as in claim 1, wherein said means for releasably mounting said interchangeable frame member in said shaving head frame includes spring loaded tongue means in each of said ends of said interchangeable frame member, and said shaving frame includes matching recesses on inner surfaces for engagement with said spring loaded tongue means.

* * * * *

UNITED STATES PATENT AND TRADEMARK OFFICE

CERTIFICATE OF CORRECTION

PATENT NO. : 4,578,861

DATED : April 1, 1986

INVENTOR(S) : Otto Schweingruber, Peter Hilfinger, Dietrich Pahl

It is certified that error appears in the above-identified patent and that said Letters Patent is hereby corrected as shown below:

Column 2, line 38, cancel "and".
Column 2, line 42, after "FIG. 3" cancel "." and insert --; and--.
Column 2, after line 42, add the following paragraph:
--FIG. 5 is a side view of a further embodiment of the shaving head, partially cut away.--.
Column 3, after line 52, insert the following paragraph:
--FIG. 5 is similar to FIG. 1 except that the interchangeable frame 9 is provided with projections 25' and 26' which respectively cooperate with cutouts 22' and 23' formed in the shaver housing 4.--.
Column 3, line 53, delete "two".
Column 4, lines 36 and 45, delete claim 2 in its entirety.
Column 4, line 46, change "8" to --1--.
Column 6, lines 17 to 19, delete claim 8 in its entirety.
Column 6, line 56, change "8" to --9--.
Column 6, line 60, delete "second" and substitute --third--.
Column 6, line 60, after "means" insert --including a second cut out portion--.
Column 6, line 63, delete "second cut out means" and substitute --fourth projection means--.
Column 6, line 65, before "means" insert --portion of said third projection--.
Column 6, line 65, delete "second" and substitute --fourth--.
Column 7, line 1, change "10" to --7--.
Column 7, lines 4 to 6 and column 8, lines 1 to 4, delete claim 12 in its entirety.
Column 8, add the additional claim 13.
--13. The dry shaver as in claim 10, wherein said second and

UNITED STATES PATENT AND TRADEMARK OFFICE

CERTIFICATE OF CORRECTION

PATENT NO. : 4,578,861

DATED : April 1, 1986

INVENTOR(S) : Otto Schweingruber et al.

It is certified that error appears in the above-identified patent and that said Letters Patent is hereby corrected as shown below:

fourth projection means are rounded. --.

Signed and Sealed this

*Fifth* Day of *August 1986*

[SEAL]

*Attest:*

DONALD J. QUIGG

*Attesting Officer*

*Commissioner of Patents and Trademarks*